United States Patent [19]

Taggart

[11] 4,426,061

[45] Jan. 17, 1984

[54] METHOD AND APPARATUS FOR FORMING INSULATED WALLS

[76] Inventor: John R. Taggart, 100 NE. 6th St., Lot 221, Homestead, Fla. 33030

[21] Appl. No.: 174,849

[22] Filed: Aug. 4, 1980

[51] Int. Cl.[3] ..... E04G 11/06; E04G 17/06

[52] U.S. Cl. ..... 249/45; 52/127.3; 52/309.12; 52/410; 249/191; 249/216; 249/218; 264/35

[58] Field of Search ..... 249/40, 34, 213, 44, 249/42, 45, 46, 191, 216, 218; 52/309.12, 127.3, 408, 410

[56] References Cited

U.S. PATENT DOCUMENTS

| | | | |
|---|---|---|---|
| 3,103,730 | 9/1963 | Carlton | 249/45 |
| 3,228,161 | 1/1966 | McCown | 52/410 |
| 3,241,803 | 3/1966 | Foy | 249/40 |
| 3,426,992 | 10/1967 | Buyken | 249/40 |
| 3,435,580 | 4/1969 | Merrill et al. | 52/405 |
| 3,547,398 | 12/1970 | Furr et al. | 249/40 |
| 3,729,159 | 4/1973 | Faster | 249/40 |
| 4,054,259 | 10/1977 | Johnson | 249/40 |

FOREIGN PATENT DOCUMENTS

| | | | |
|---|---|---|---|
| 1438636 | 6/1976 | United Kingdom | 249/218 |

*Primary Examiner*—James H. Derrington
*Attorney, Agent, or Firm*—Duckworth, Allen, Dyer & Pettis

[57] ABSTRACT

A method and apparatus is disclosed for forming insulated walls by pouring concrete directly on a form made in part of insulating material which will remain in place after the concrete sets. An apparatus for spacing the sheets of insulating material from the sheets of other material to create a concrete form is also disclosed, which also provides the function of bringing adjacent sheets of insulating material to create an adequate seal for the concrete. A tie holder for supporting cross members is also disclosed.

8 Claims, 8 Drawing Figures

METHOD AND APPARATUS FOR FORMING INSULATED WALLS

BACKGROUND OF THE INVENTION

This invention relates in general to a method and apparatus for building, and more particularly to a method and apparatus for creating concrete forms for reinforced insulated concrete walls.

In most prior art systems for making concrete walls, sheets of rigid material generally treated to enhance the ability to release from a set concrete surface, are disposed in a parallel relationship with some form of spacing hardware attached to the panels in order to maintain the appropriate spacing. Usually, the hardware includes waler's brackets, for supporting a waler to lend strengthing properties to the forms. Many types of waler brackets are described in the prior art including U.S. Pat. Nos. 3,547,398 (Furr, et al., 12/15/1970); 3,426,992 (Buyken, 10/11/1967); 3,729,159 (Foster, (4/24/1973); 3,241,803 (Foy, 3/22/1966); 4,054,259 (Johnson, 10/18/1977); 3,730,476 (Prichard, 5/1/1973); 3,599,929 (Holley, et al., 8/17/1971); 3,286,976 (Lynch, 11/22/1966); 3,462,107 (Buyken, 8/19/1969); 3,462,108 (Buyken, 8/19/1969); and 3,347,510 (Buyken, 10/17/1967).

One of the disadvantages of the waler brackets described in the prior art is that they are not designed to join together adjacent form panels, but rather are to be placed towards the center of the form panels, thus requiring additional hardware to join panels together. Another disadvantage is that they are unsuitable for use with insulation material which tends to have low stress bearing capabilities.

Additionally, in most construction systems walls are first formed and insulation material is then installed by skilled laborers thereby increasing the overall costs of the system.

SUMMARY OF THE INVENTION

Cost savings can be achieved by forming a concrete wall directly on an insulation panel. The method of the present invention contemplates creating a concrete form by placing reinforced sheets of insulating material parallel to form panels. The sheets of insulating material are separated by a spacing device and the concrete is poured directly on the form created. After the concrete is set the form panels are removed and the sheets of insulating material remain in place.

The spacing device includes a spacing member disposed between the substantially parallel sheets of insulating material and form panels. The spacing member is engaged from the exterior portion of the form panels and sheets of insulating material by T-shaped screws. The spacing member is provided with a tapered bracket that engages the reinforced borders of the sheets of insulating material so that as the spacing member is compressed against the sheets of insulating material, the tapered bracket forces adjacent sheets of insulating material to come together. The spacing member is also provided with tie holders which are adapted to engage the T-shaped screws and compress the sheets of insulating material and the form panels on the spacing member.

BRIEF DESCRIPTION OF THE DRAWINGS

Further details are explained below with the help of the examples illustrated in the attached drawing in which.

DETAILED DESCRIPTION OF THE INVENTION

Figure 1:
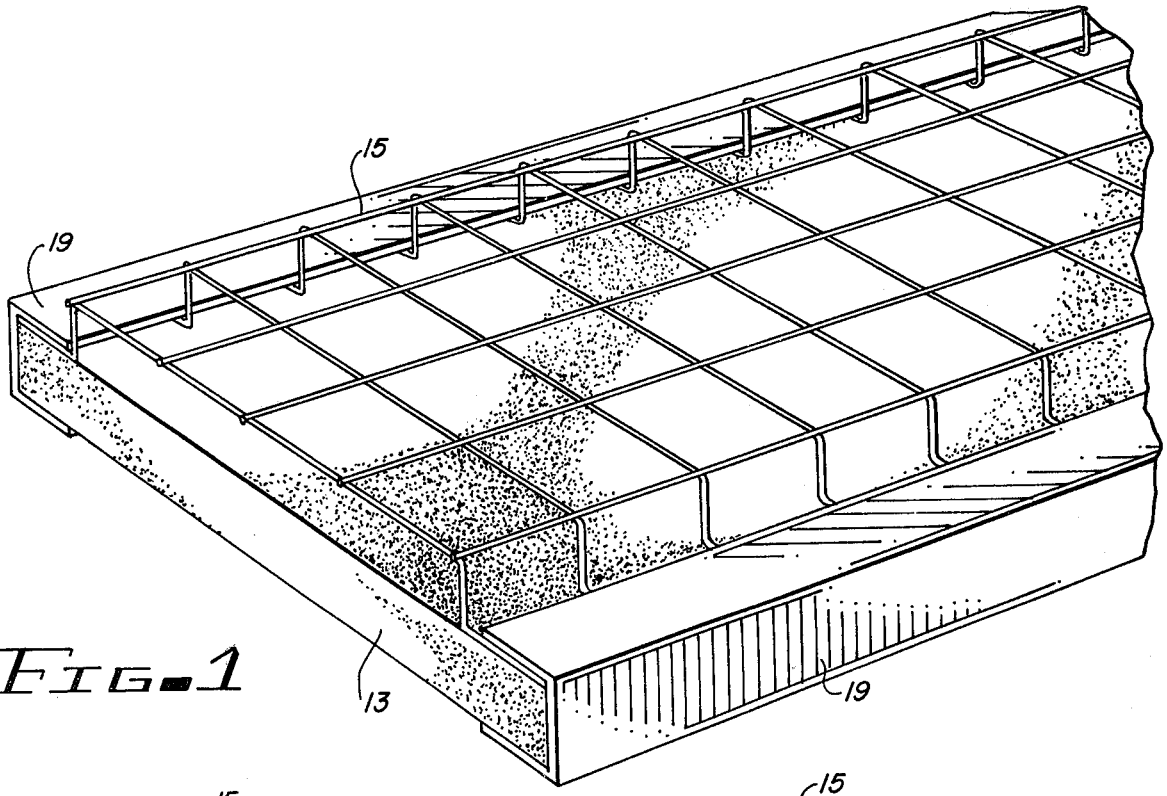
FIG. 1 is a perspective view of an insulation module according to the present invention.
Figure 2:
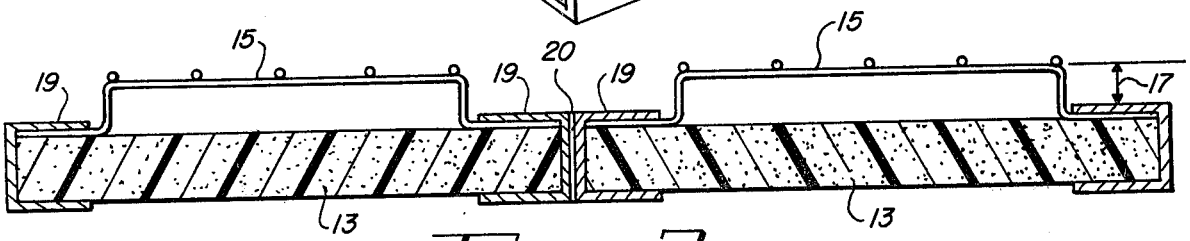
FIG. 2 is an end view of a pair of insulation modules disposed adjacent to one another.

As shown in FIG. 1, the concrete wall form of the system of the present invention includes an insulation module 11. Typically the insulation module 11 is two feet wide by room height and its thickness may depend on the insulation qualities of the material. The insulation module 11 has an insulation panel 13 made of adequate insulation material such as styrofoam for example. Disposed adjacent to a surface 14 of the insulation panel 13 is reinforcing material 15 such as wire mesh. The reinforcing material, as is shown in FIG. 2, includes an offset distance 17 to maintain the reinforcing material away from the insulation panel surface 14. Adjacent to each lateral side of the insulation panel 13 is disposed a U-shaped cap 19 made of sheet metal, for example, which serves to secure the reinforcing material 14 to the insulation panel 13. Disposed in between adjacent U-shaped caps is a gasket 20 made of styrofoam or other suitable material.

Figure 3:
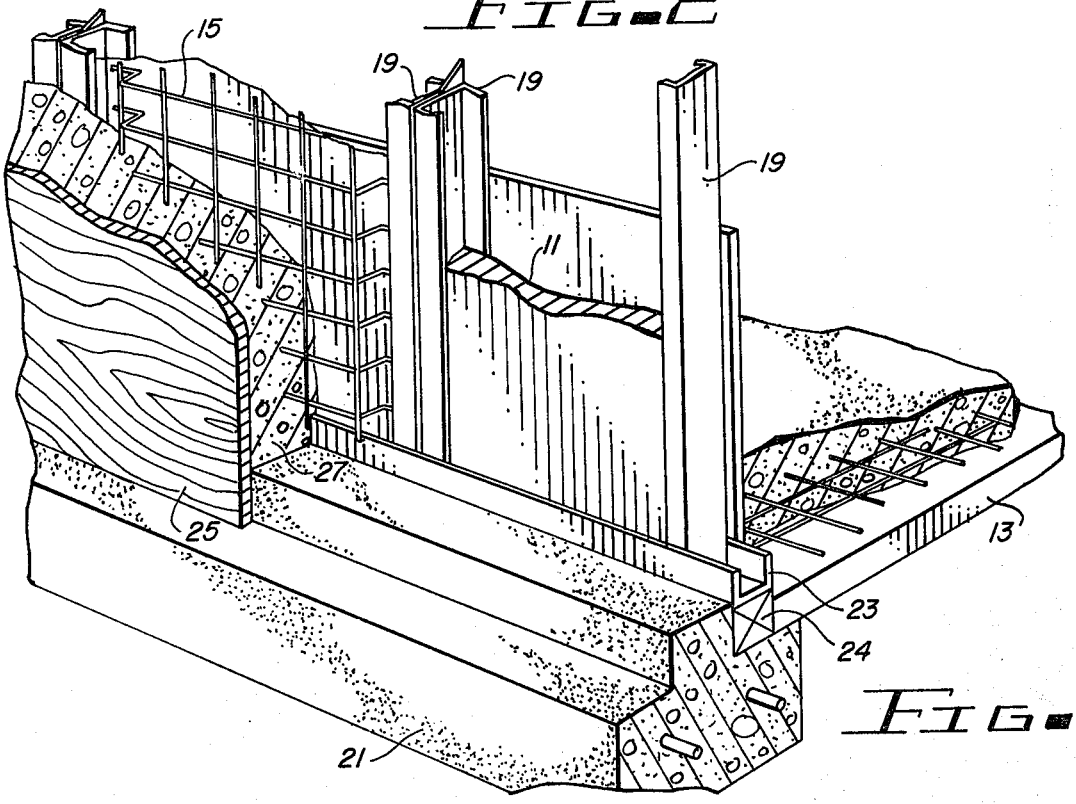
FIG. 3 is a cut away view of the components of the wall forming system.

The building system of the present invention contemplates, as shown in FIG. 3, the use of a reinforce concrete foundation 21 substantially in the form of a T beam. A U-shaped channel 23, which may be made of sheet metal is secured to one side of the base of the T foundation 21 or a floor slab, and is extended throughout the foundation. Immediately below the channel 23 is disposed an insulation plank 24 for the purpose of maintaining the insulation throughout the building.

Disposed on the channel are a plurality of insulation modules 11. Disposed to the other side of the base of the T are a plurality of form panels 24, which are typically made of plywood or other easily available construction material. Concrete is poured in the form made by the form panels 25 and insulation modules 25 and 11 respectively to create the wall 27. The side of the insulation module 11 opposite to the wall 27, corresponding to the inside of the building, may be finished by securing gypsum boards, or drywalls, to the U-shaped caps of the insulation module. This will result in a strong reinforced concrete structure with extremely efficient insulation built in, and a finished drywall interior wall surface.

Figure 4:
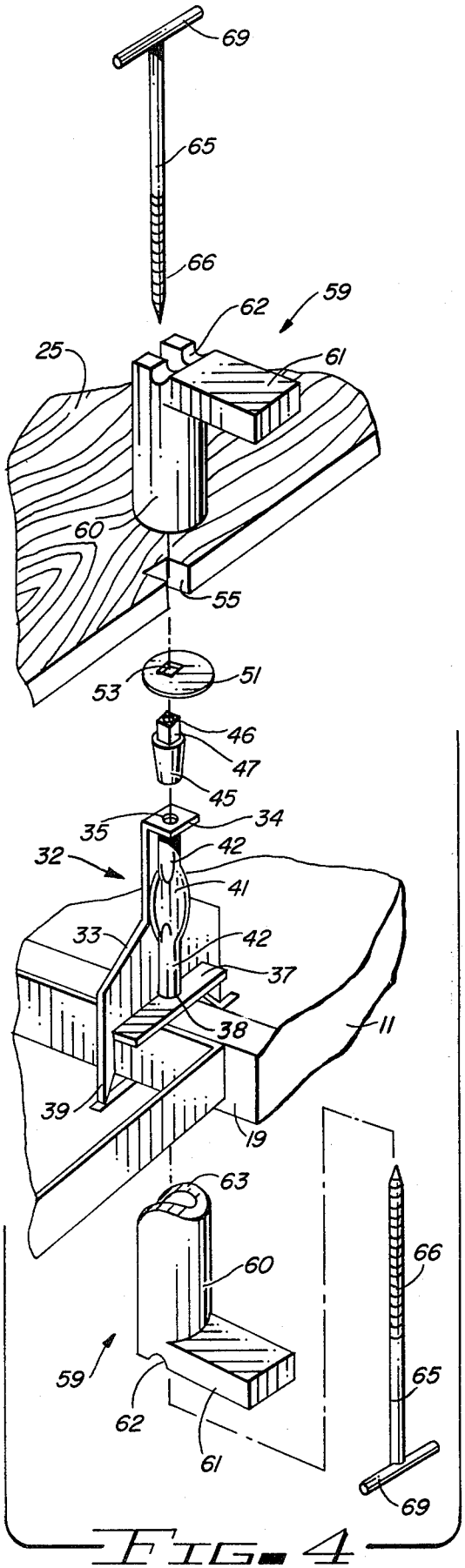
FIG. 4 is a view of the spacing device.

In making the concrete forms from the insulation modules and form panels 11 and 23 respectively, a spacing device 32 shown in FIG. 4 is provided. The spacing device 32 includes a metal bracket 33 with a first perpendicularly projecting end piece 34 having a hole 35 thereon. The second end of the bracket 33 has a retaining end piece 37 having a width that is approximately the width of two adjoining U-shaped caps 19 plus the gasket 20. The retaining end piece 37 has a hole 38 at the center.

Also disposed on the second end of the bracket 33 are two projecting end portions 39 which are disposed a distance substantially equal to the width of two adjoining U-shaped caps 19, away from each other at the base. The two projecting sections 39 are outwardly tapered so that as the insulation panels 13 are pressed against the retaining end piece 37, the projecting members 39 force the two adjacent panels together by a cam-like action on the periphery of the U-shaped caps 19, thereby compressing the gasket 20. Disposed adjacent to the brackets and cooperating with the holes 35 and 38 is a central member 41 having internally threaded holes 42 at either end thereof. The central member 41 may be square and made of plastic material. Adjacent to the end 34 is disposed another spacing piece 45 having a hole 46 extended therethrough, which may be internally threaded. The spacing piece 45 has one end portion 47 with a substantially square cross section. A washer 51 is also provided with a square hole 53 disposed eccentrically on the washer and adapted to engage the end portion 47 of the spacing piece 45. The square hole 53 is off-center to provide a larger area of protrusion to engage another form panel 25. The other panel of type typical form panel 25, which is usually made of plywood, is provided with a notch 55 which is adapted to engage the square end portion 47 of the spacing piece 45. Disposed towards the exterior of the form panel 25 is a retainer piece 59 having a first portion 60 with a substantially U-shaped cross section and a second portion 61 substantially perpendicular thereto with a notch 62 thereon. The substantially U-shaped portion 60 has an end section 63 which is substantially curved towards the opening provided. Also provided is a T-shaped screw 65 having a threaded position 66 adapted to engage the internally threaded holes 42 and a cross member 69 adapted to engage the notch 62 on the second portion 61 of the retainer piece 59.

During the set-up stage the insulation modules 11 may be placed vertically one end to channel 23 which is provided in the foundation 21. The insulation modules 11 are joined together at the U-shaped caps 19 by the metal bracket 33. The projecting members 39 engage the insulation panels 13 and the two adjoining U-shaped caps 19. The T-shaped screw 65 may be set between the two adjoining sheet metal caps 19 and through the hole in the end piece 37 and into the central member 41. Because of the diameter of the T-shaped screw 65 a small space will be left between two joined insulation modules 11. In order to seal this space the gasket 20 is disposed between two adjacent U-shaped caps and may be glued to one side of one of the sheet metal caps thereby filling the void area. A retainer piece 59 is then pivoted about the cross member of the T-shaped screw 65 and forced downwardly so that the T-shaped screw 64 is put in tension with the retainer piece 59 and the two projecting ends 39 are compressed into the insulation panel and will pull together the U-shaped caps of the modules. Simultaneously gasket 20 will be compressed between the two U-shaped caps 19, thus locking the two panels together with a tight seal from the gasket 20.

As can be seen from the description above as the insulation modules are put in compression the projecting members 39 force the adjacent U-shaped caps 19 to come together and compress gasket 20 that that an adequate seal is provided between the two adjacent insulation modules 11.

Figure 7:
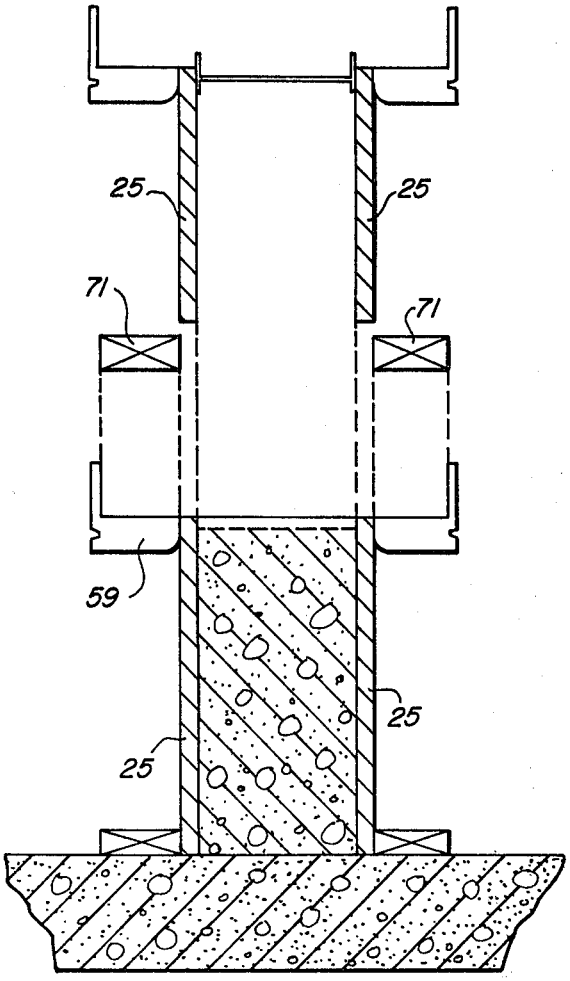
FIG. 7 is a cross-sectional exploded view of a wall built in accordance with the invention.

The wall may then be built upwardly by placing another form panel 25 on top of the already existing form panel and a second layer of concrete forms is built around the perimeter of the wall (see, for example, FIG. 7). The second set of form panels 25 are locked in place by the compression provided by waler or cross beams 71. As the cross beams 71 is placed in the retainer piece 59 it will compress the form panel inwardly towards the washer 76 which will then hold the form panel in its proper place. Thereafter the T-shaped screw 65 are removed along with the retainer pieces 59 and then the exterior form panels 25 are removed. The result is a reinforced concrete wall connected to insulation palens. The exterior form panels 25 can be reused many times over, or later, for example, as roofing material. The retainer piece 59 can also be used to support walers or cross beams 71 which strengthen the insulation panels 13 to prevent deformation while the concrete is setting.

Figure 5:
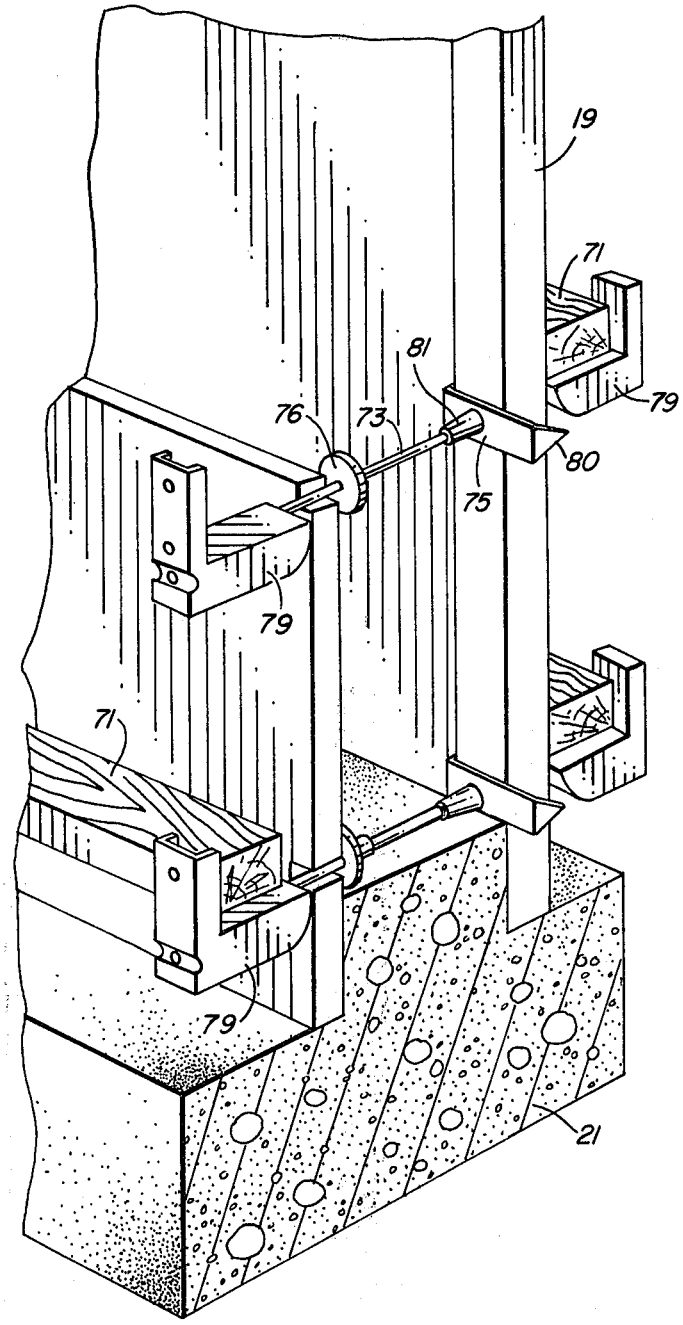
FIG. 5 is an alternative embodiment for the spacing device.

As can be seen in FIG. 5, an alternative embodiment may comprise an elongated central portion 73 having two internally threaded end portions 75 and 76 with an end bracket 79 having a width spanning the width of two adjoining U-shaped caps 19, and two projecting end portions 80 and 81 adapted to engage the adjoining U-shaped caps 19.

As can be seen in FIG. 7, the building procedure may be used without the use of the insulation modules 11. Rather two form panels 25 may be used and the wall may be built upwardly by placing a second set of form panels on top of the first set and locking them in place by waler or cross member 71. In this fashion a wall of any desired height may be built.

Figure 8:
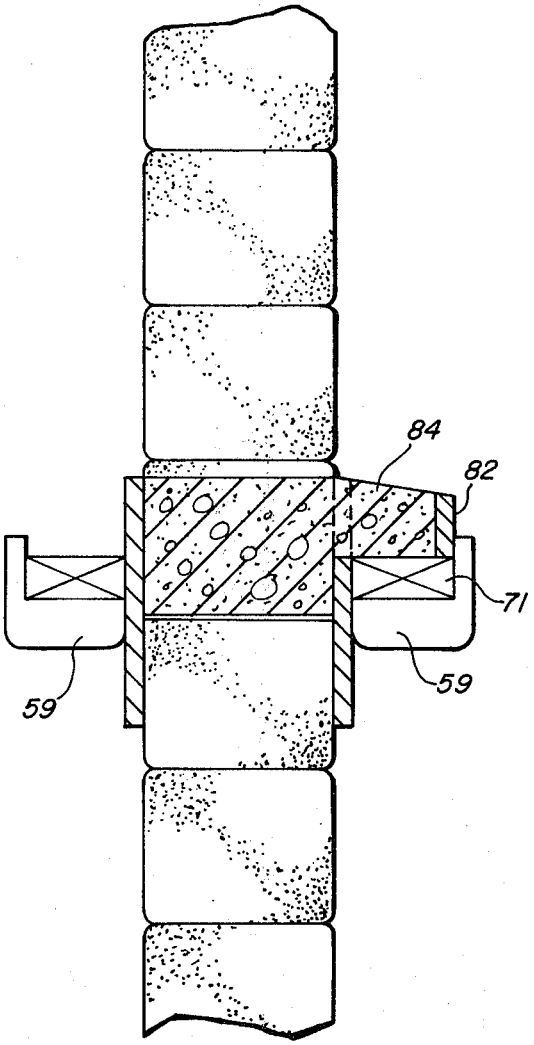
FIG. 8 is a cross-sectional view of a window sill built in accordance with the invention.

The versatility of the system is also evidenced in FIG. 8 which shows the use of the retainer piece 59 together with the waler 71 and a short form panel 82 to create a window sill 84.

The formation of windows in this construction can be provided by having specialized modules 83 of specific length, as shown in FIG. 8. There two shortened modules 85 and 86 are shown adjoining and supporting a window sub jamb 87, having a third transversly disposed insulation module 88 of reduced width disposed on top of the sub jamb 87. The window sub jamb 87 forms the opening in the walls and remains as a permanent part of the building. Most standard pre-finished window units may be secured to the sub jambs, thus completing the window unit. The width of the sub jamb 87 is substantially the same as the desired width of the wall, and as the concrete is poured the sub jamb 87 can be formed directly in place. Door jambs may be formed from the same single profiled stock shape as the window jambs and are connected in the same manner to the insulation moduals.

Figure 6:
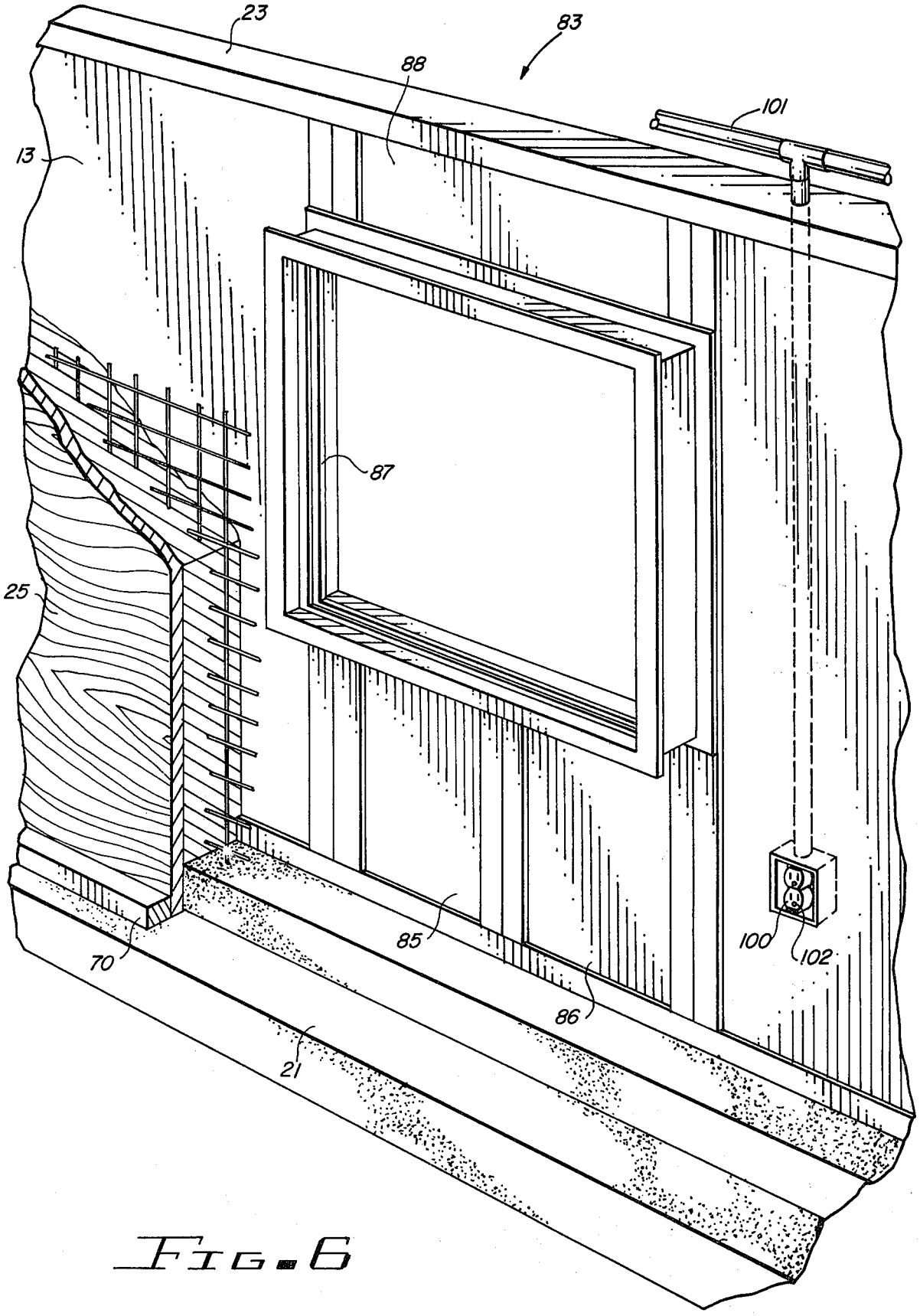
FIG. 6 is a perspective cut away view of a wall made in accordance with the method of the invention including window components.

As can be appreciated by the detailed description of the invention so far, such a building system will offer an efficient way of building homes and other structures. All of the material can be pre-cut and modularized, and one need only connect the modules together. The system of erection is so simple that previous construction experience is not required due to the simplicity of the connection device. In addition, this type of construction will offer ideal insulation to the building. The insulation modules 11, which can be made of styrofoam may be provided with installed fixtures and fully wired thereby necessitating only to be connected to the main supply of electricity. A typical package to be offered to the builder would include building blue prints and specifications with numerous floor plans and exterior finishes to chose from, or one can design their own home plan due to the versatility of the module panel construction. A variety of exterior wall patterns can be available to chose from. Insulation modules 11 that will lock together to form the interior side of the building, with certain modules 11 having installed fixtures 100 fully wired inside the module, as shown in FIG. 6. All prewired fixtrues need only a finished flush face plate 102 to be secured to the installed fixtures after the drywall panels are installed to the U-shaped caps of the insulation modules. All pre-wiring is connected to a central conduit chase 101 above or in the ceiling area then to the main supply.

Metal door and window sub jambs 87 are designed to lock onto the insulation modules anywhere in the perimeter wall line desired. Both the window and door sub jambs are constructed from the same profiled stock and are designed to keep the concrete from incrouching upon their desired opening areas during the placement of the wet concrete. After the concrete has become hard, finished window units are secured to the sub window jambs, and the finished doors are hinged to the sub door jambs. Also to be provided are U-shaped channels 23 for the perimeter wall and to set the insulation modules 11 into the foundation 21. The form panel 25 can all be pre-cut from standard plywood sheets of four foot by eight foot into two foot by eight foot and be prepared with the notches 55 for connection to the insulation modules 11.

Also to be provided are all connecting hardware including spacing devices 32 for the form panels 25 to connect the insulation modules 11. The exterior of the wall may be patterned by providing thin plastic sheets or styrofoam panels with imprinted patterns so that when the concrete sets the pattern will be set thereby enhancing the outward appearance of the concrete wall. For example, the concrete wall can simulate concrete blocks or bricks on the exterior. Finished exterior doors will be provided and prepared with the hardware holes and hinged recesses.

The interior can be finished by attaching drywall gypsum boards 111 to the sheet metal caps 19 of the insulation moduals which may be purchased locally. All of the interior portion materials can be shipped to the job site by any supplier. The interior ceilings can also be covered with styrofoam insulation plank 113 secured to the under side of the roof rafters and then finished over with gypsum board.

Roof trusses can be provided or the specification can be sent to a local dealer to be fabricated and delivered to the job site. All wood members needed to complete the roof structure can be precut and need only to be nailed into place. If only one home is to be built from the exterior retaining form panels 25, then these panels can be reused as the sub-roofing material and be nailed to the trusses, thus reducing the cost of roof sheeting. Alternatively, the exterior retaining forms can be used many times over to form the exterior of the walls of other buildings before ultimately becoming the sub-roof to one.

I claim:

1. A device for spacing a pair of adjacent sheets of insulating material from a concrete form sheet comprising:

a pair of elongated caps having a U-shaped cross section, each adapted to be disposed on adjacent ends of a pair of sheets of insulating material;

a spacing member adapted to be disposed between sheets of insulating material and a form sheet, such spacing member having a threaded opening at each end;

a bracket disposed adjacent to said spacing member, said bracket having longitudinal opening therethrough and a pair of projecting outwardly tapered end portions adapted to engage said pair of elongated caps;

first means disposed through said elongated caps and the longitudinal opening of said bracket engaging said spacing member;

second means adapted to be disposed through a concrete form sheet for engaging said spacing member;

first means adapted to engage adjacent sheets of insulating material and coupled to said first means for engaging for tensioning said spacing member; and second means adapted to abut on a concrete form sheet and coupled to said second means for engaging and for tensioning said spacing member.

2. The device or claim 1 wherein said first means for engaging comprises a T-shaped screw disposed in one of said threaded openings.

3. The device of claim 2 wherein said first means for tensioning comprises a tie holder having a first portion with a groove extending through the length of the first portion and having an end with a substantially curved corner, said tie holder having a second portion integrally formed with and disposed substantially perpendicular to the first portion; said second portion provided with a notch disposed substantially perpendicular to the groove of said first portion.

4. The device of claim 2 wherein said second means for tensioning comprises:

a tie holder having a first portion with a groove extending through the length of the first portion and having an end with a substantially curved corner, said tie holder having a second portion integrally formed with and disposed substantially perpendicular to the first portion; said second portion provided with a notch disposed substantially perpendicular to the groove of said first portion.

5. A concrete form and lock set comprising:

at least one form sheet;

at least a pair of adjacent sheets of insulating material disposed parallel to and a predetermined distance from said at least one form sheet;

at least a pair of metal caps having a U-shaped cross section, each one of said pair disposed on an end of a respective one of said sheets of insulating material whereby said metal caps are disposed adjacent to each other;

a spacing member disposed between the sheets of insulating material and the form sheet, said spacing member having a threaded opening at each end;

a bracket disposed adjacent to said spacing member, said bracket having a longitudinal opening therethrough and a pair of projecting outwardly tapering portions adopted to compress into the sheets of insulating material and engage said adjacent metal caps; and means coupled to the respective threaded openings on the spacing member for tensioning said spacing member while compressing said adjacent sheets of insulating material and form sheet whereby said bracket compresses into the sheets of insulation material and forces the adjacent caps together.

6. The concrete form and lock set of claim 5 wherein said means for tensioning while compressing comprises:

a first T-shaped screw having a threaded post section and bar section substantially perpendicular to the post section, said first T-shaped screw disposed through the metal caps and the longitudinal opening on said bracket and fastened to one of the threaded openings on said spacing member;

a second T-shaped screw having a threaded post section and a bar section substantially perpendicular to the post section, said second T-shaped screw disposed through said form sheet and fastened to the other threaded opening on said spacing member;

a first retainer means coupled to the bar of said first T-shaped screw for locking the adjacent insulating sheets; and a second retainer means coupled to the bar of said second T-shaped screw for locking the form sheet.

7. The concrete form and lock set of claim 6 wherein said first retainer means for locking comprises:

a retainer member having a first portion with a groove extending through the length of the first portion and having an end with a substantially curved corner, said retainer member having a second portion integrally formed with and disposed substantially perpendicular to the first portion, said second portion provided with a notch substantially perpendicular to the groove of said first portion, said retainer member disposed so that the post portion of said first T-shaped screw is inside said groove and the bar portion is in said notch.

8. The concrete form and lock set of claim 6 wherein said second retainer means for locking comprises:

a retainer member having a first portion with a groove extending through the length of the first portion and having an end with a substantially curved corner; said retainer member having a second portion integrally formed with and disposed substantially perpendicular to the first portion, said second portion provided with a notch substantially perpendicular to the groove of said first portion, said retainer member disposed so that the post portion of said second T-shaped screw is inside said groove and the bar portion is in said notch.

* * * * *